United States Patent [19]

Farney et al.

[11] 3,953,759

[45] Apr. 27, 1976

[54] INTERDIGITAL SLOW WAVE CIRCUIT FOR ELECTRON TUBES

[75] Inventors: George K. Farney, Boxford; Andrew S. Wilczek, Beverly; Roger A. LaPlante, Ipswich, all of Mass.

[73] Assignee: Varian Associates, Palo Alto, Calif.

[22] Filed: Mar. 20, 1975

[21] Appl. No.: 560,665

[52] U.S. Cl. ..... 315/3.5; 315/39.3; 315/39.73

[51] Int. Cl.[2] ..... H01J 25/34

[58] Field of Search ..... 315/3.5, 39.73, 3.6

[56] References Cited

UNITED STATES PATENTS

| | | | |
|---|---|---|---|
| 2,532,545 | 12/1950 | Everhart | 315/39.73 X |
| 2,730,678 | 1/1956 | Dohler et al. | 315/39.73 X |
| 2,888,595 | 5/1959 | Warnecke et al. | 315/39.73 X |
| 2,888,598 | 5/1959 | Palluel | 315/39.73 X |
| 3,305,693 | 2/1967 | Hull | 315/39.73 X |
| 3,361,926 | 1/1968 | Farney | 315/39.73 X |
| 3,450,932 | 6/1969 | Farney | 315/39.73 X |
| 3,456,151 | 7/1969 | Staats | 315/39.73 X |

*Primary Examiner*—Saxfield Chatmon, Jr.
*Attorney, Agent, or Firm*—Stanley Z. Cole; David R. Pressman; Richard B. Nelson

[57] ABSTRACT

An interdigital delay line for crossed field tubes has vanes extending from their interaction faces to a back wall. One end of each vane extends to the end of the face. The other end is cut out behind the interaction face leaving the face projecting. The interaction impedance is almost as high as that of a line with fingers supported by stubs at their centers, while the thermal dissipation is higher, approaching that of a line with vanes extending over the entire length of the fingers.

9 Claims, 8 Drawing Figures

INTERDIGITAL SLOW WAVE CIRCUIT FOR ELECTRON TUBES

FIELD OF THE INVENTION

The invention pertains to high frequency electron tubes and slow-wave interaction circuits for use therein, particularly for crossed field microwave tubes.

In traveling wave tubes such as magnetron oscillators and crossed-field amplifiers the slow wave circuit typically has a spaced array of parallel interaction faces perpendicular to the drift direction of the beam. A large portion of the beam electrons are collected on the circuit and the resultant heat energy is removed by thermal conduction.

PRIOR ART

A widely used slow wave circuit is the interdigital line composed of a pair of straps extending in the direction of propagation, similar to a two-wire transmission line. Interleaving fingers extend alternatively from one strap toward the other to define an interaction surface containing their faces and a meandering wave path between them.

The basic interdigital line described above has very poor thermal dissipation ability because the conductors are insulated from any ground plane which can be cooled, such as the envelope of the tube.

A line with increased cooling is described in U.S. Pat. No. 3,361,926 issued Jan. 2, 1968, to G. K. Farney. In this line, conductive stubs connect the center of each finger to a conductive wall behind the interdigital array, away from the electron stream.

In another prior-art line the entire face of the interdigital line is extended back to the wall as conductive combs to form an open-ended half of a folded waveguide. This waveguide structure has a maximum thermal conductivity. However, wave field energy is stored throughout the entire waveguide in additon to the useful fringing electric field at its open face, thus the impedance-bandwidth product of the circuit is severely reduced below that of the basic unsupported interdigital line or even the above described stub-supported line.

SUMMARY OF THE INVENTION

The present invention provides a line with interaction impedance approaching that of the stub-supported interdigital line combined with thermal conductivity intermediate the stub supported line and the folded waveguide. The novel structure of the inventive line achieves these two ostensibly incompatible properties rather than merely a compromise of the impedance and conductivity of the two prior-art lines described above.

Briefly, the line of the present invention comprises two sets of interdigitated fingers. Each finger is extended completely to one of its ends as a vane extending to the back wall, as in the folded waveguide. The other end of the finger is not extended to the back wall but projects beyond the supported portion. The thermal conductivity is thus obviously intermediate that of a folded waveguide and a stub supported line.

The surprising result is that the impedance is not degraded to the extent that might be expected from the increased area of the backward-extending support portions. One simplified after-the-fact explanation is that the solid portion of a given vane is not juxtaposed to the solid portions of the adjacent vanes which have rf voltage polarity opposite that of the given vane. Rather, the solid portion of the given vane sees through the cut away portions of the adjacent vanes to vanes attached to its own strap which have an rf phase differing from the given vane's by much less than 180°. Therefore the energy stored in the rf electric field is much less than what would be expected from the fraction of the folded waveguide vanes retained.

A second surprising result is that the cut away portion of the vane can be behind either the end of the finger attached to the strap or the free end.

DETAILED DESCRIPTION OF THE PREFERRED EMBODIMENTS

Figure 1:
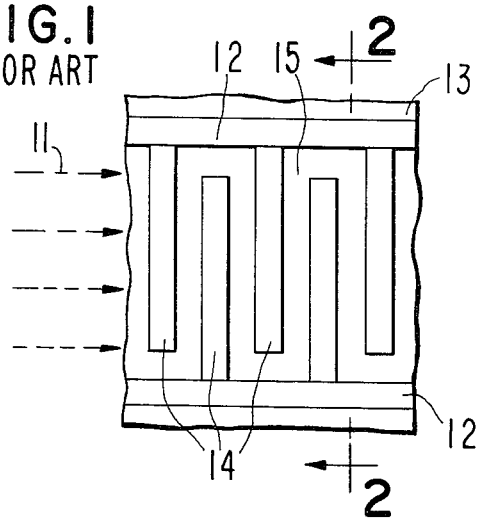
FIG. 1 PRIOR ART
FIG. 1 is a front view from the side of the electron stream of a prior art folded waveguide delay line.
Figure 2:
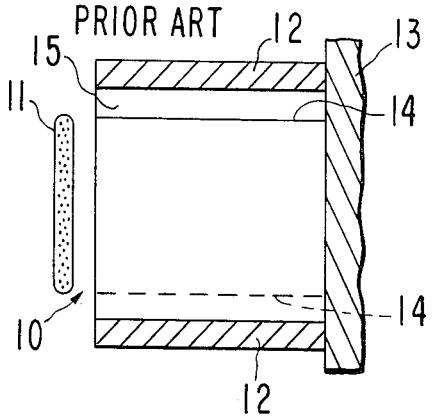
FIG. 2 PRIOR ART
FIG. 2 is a sectional end view of the waveguide line of FIG. 1 taken through line 2—2.

The prior art delay line of FIGS. 1 and 2 is formed of metal parts as of copper thermally and electrically conductively joined as by brazing. It consists of an interdigitally shaped face 10 lying in a surface, adapted to interact with a stream of electrons 11. A pair of strap members 12 extending in the direction of mean electron flow project back from face 10 to a wall member 13 also extending in the direction of flow.

Finger members 14 extending perpendicular to the direction of flow also extend as uniform section vanes back to wall 13. Wall 13 acts as a heat sink and may be part of the vacuum envelope of the electron tube. An electromagnetic wave excited on the structure propagates through the meandering open space passage 15 between the conductive members 12, 13, 14, resembling one-half of the $TE_{10}$ mode in a shallow rectangular waveguide. Electric field fringing outside face 10 interacts with electron stream 11 to amplify the wave. Meanwhile, electrons from stream 11 strike face 10 and their energy is converted to heat. The structure of FIGS. 1 and 2, by virtue of the large cross section of metal connecting face 10 and wall 13, is capable of dissipating large amounts of heat. On the other hand, considerable wave energy is stored throughout the entire half waveguide section, so the product of beam interaction impedance and bandwidth is small. High values of impedance-bandwidth product are desirable for traveling wave amplifiers and voltage tunable oscillators.

Figure 3:
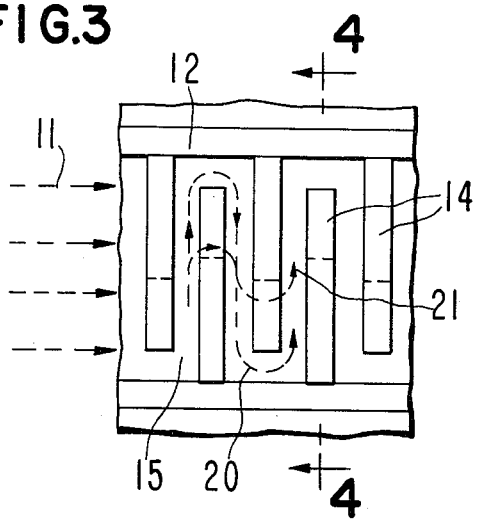
FIG. 3 is a front view of a delay line according to the present invention.
Figure 4:
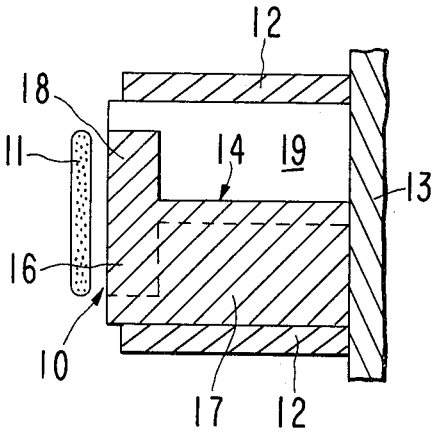
FIG. 4 is a sectional end view of the delay line of FIG. 3 taken through line 4—4.

FIGS. 3 and 4 illustrate a preferred embodiment of the present invention wherein fingers 14 whose front surfaces form the interaction surface 10 are joined at one end of each, alternately to one and the other of strap members 12 extending in the direction of electron flow and preferably extending back to wall 13. One end 16 of each finger extends as a vane section 17 back to wall 13, preferably joined over its backward extent to a strap 12, although a gap or aperture in either vane or strap would have small effect on the properties. Vane 17 does not extend to the other end 18 of finger 14, leaving an open space 19 between end 18 and wall 13.

When an electromagnetic wave is excited on the structure of FIGS. 3 and 4 the fields between the fingers 14 propagate in a manner analogous to the $TE_{10}$ half-waveguide wave of FIGS. 1 and 2, following a meandering path 20. However, wave energy does not have to propagate to the end of open space 19 and back, but the back side of the wave can take a short-cut 21. The decreased volume required to be filled with wave fields represents a decrease in total wave energy stored in the line for a given fringing interaction field. This is equivalent to an increase in the impedance-bandwidth product of the line.

Figure 5:
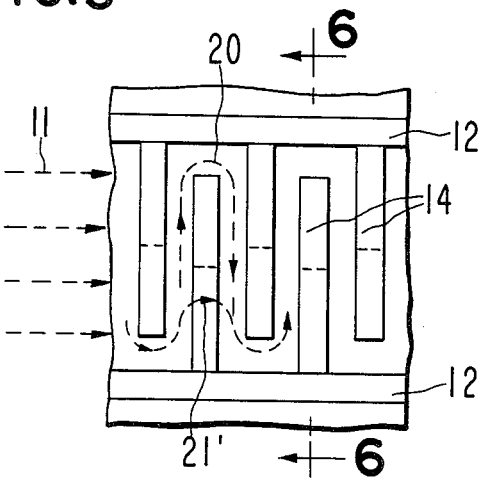
FIG. 5 is a front view of an alternative embodiment of the invention.
Figure 6:
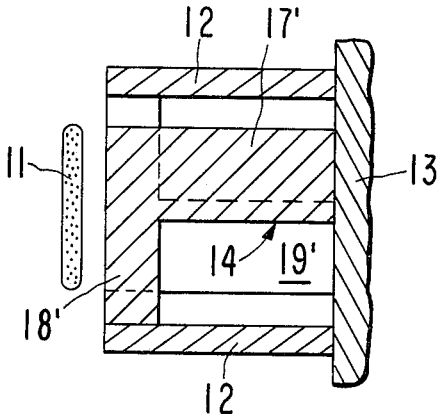
FIG. 6 is a sectional end view of the delay line of FIG. 5 taken through line 6—6.

FIGS. 5 and 6 show another preferred embodiment wherein the end 18' of finger 14' in front of the open space 19' is the end joined to strap 12. The impedance improvement is not as great as for the circuit of FIGS. 3 and 4 because the short-cut wave path 21' is short circuited at both ends and more energy must propagate around the longer path. However, the line of FIGS. 5 and 6 has better thermal dissipation than that of FIGS. 3 and 4 because both ends of fingers 14 are more directly connected to heat sink 13.

Figure 7:
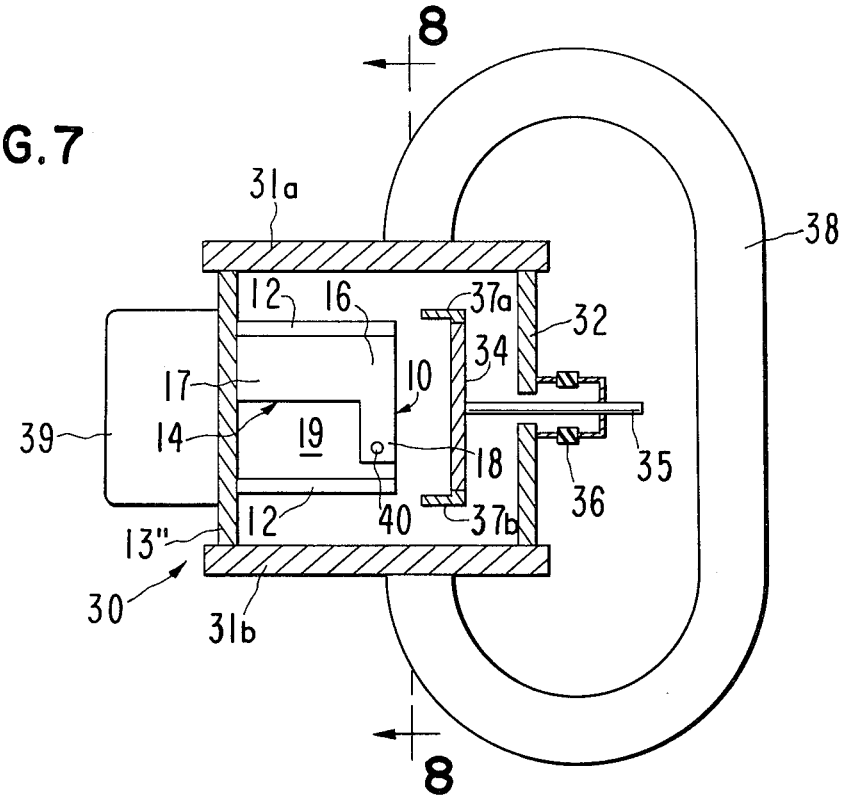
FIG. 7 is a sectional end view of a crossed field amplifier tube embodying the inventive delay line.
Figure 8:
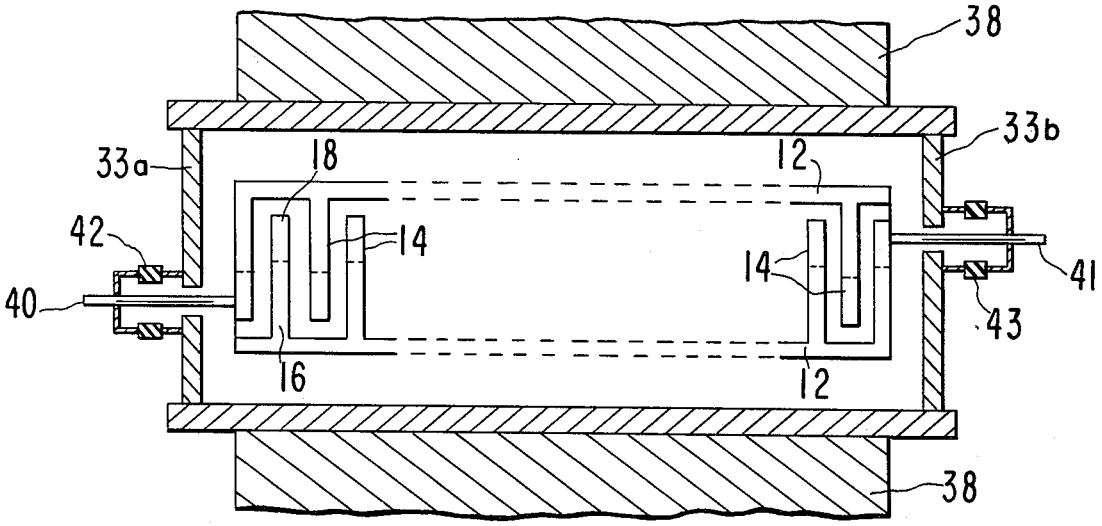
FIG. 8 is a sectional front view of the tube of FIG. 7 taken through line 8—8.

FIG. 7 is a section of a crossed field amplifier utilizing the present invention. The vacuum envelope 30 comprises a pair of parallel ferromagnetic plates 31*a*, *b* joined by vertical walls 13'', 32, 33*a* and 33*b* (FIG. 8) of nonmagnetic metal such as copper. An electron emissive cathode 34 as of porous tungsten impregnated with barium aluminate extends substantially throughout the length of the tube, supported on one or more metallic leads 35 which are mounted insulated from envelope 30 by dielectric vacuum seals 36, as of alumina ceramic. In operation, cathode leads 35 are connected to means, not shown, for supplying a voltage negative to that of envelope 30. At the top and bottom edges of cathode 34 are protruding focus electrodes 37*a*, *b*, of non-emissive metal such as molybdenum, for confining the stream of electrons from cathode 34. Cathode 34 may be operated cold as a secondary electron emitter or thermionically by a heater (not shown).

A magnet 38 spans ferromagnetic plates 31*a*, *b* to produce approximately unidirectional field between them parallel to cathode 34. Parallel to cathode 34 is the interaction face 10 of the delay line of the present invention. Parts of the line are as shown in FIGS. 3 and 4 and as described in connection therewith. Envelope side 13'' forms the back wall of the line. Cooling fins 39 as of copper are joined conductively to the outside of wall 13'' to dissipate heat conducted from the line.

Coaxial leads 40, 41 are joined to the ends of the line to couple input and output rf signal energy. They are preferably joined to the free ends 18 of the first and last of fingers 14. Leads 40, 41 are sealed to envelope 30 via dielectric seals 42, 43.

In operation, positive voltage on line interaction face 10 draws electrons from cathode 34. The perpendicular magnetic field guides the electrons in a motion generally perpendicular to the electrode faces and to the magnetic field, which motion interacts with an electromagnetic wave on the interaction surface.

There are superposed minor cyclicly varying motions, and a drift toward the delay line as the electrons lose energy to the wave. However, the motion parallel to the interaction surface is what is referred to in this specification as the direction of flow of the stream.

The above embodiments of the invention are intended to be illustrative rather than definitive because other embodiments will become apparent to those skilled in the art. For example, the conducting vanes 17 need not be the same thickness as the fingers 14. They may also have small apertures therein.

What is claimed is:

1. An electron tube comprising: vacuum envelope means, cathode means for producing a stream of electrons, guiding means for directing said stream of electrons over an elongated path, slow wave circuit means adjacent at least part of said path in energy exchanging relation with said stream, means for coupling high frequency energy output from said circuit means, said circuit means comprising; an array of conductive fingers spaced periodically in the direction of mean flow of said stream, said fingers having interaction faces adjacent said stream, first and second conductive straps at opposite ends of said fingers extending in said direction of flow, successive fingers being conductively joined alternatingly to said first and said second straps respectively to form first and second interdigital sets, a conductive wall extending in the direction of said stream and disposed from said interaction faces opposite said stream, a portion of the length of each finger extending as a vane to join said wall, said portion extending to one end of said finger and substantially short of the other end, said one end being a corresponding end of each finger in said first set and the opposite end of each finger in said second set.

2. The apparatus of claim 1 wherein said one end is the end of said finger not joined to said strap.

3. The apparatus of claim 1 wherein said one end is the end of said finger joined to said strap.

4. The apparatus of claim 1 wherein said straps extend to join said wall.

5. An electron tube for crossed field interaction comprising: vacuum envelope means, cathode means for producing a stream of electrons, means for applying a magnetic field to said stream over an elongated path, slow wave circuit means adjacent at least part of said path in wave energy exchanging relation with said stream, means for applying an electric field between said cathode means and said circuit means, said electric field being substantially perpendicular to said magnetic field, said circuit means comprising; an array of conductive fingers spaced periodically in the direction of mean flow of said stream, said fingers having interaction faces adjacent said stream, first and second conductive straps at opposite ends of said fingers extending in said direction of flow, successive fingers being conductively joined alternatingly to said first and said second straps respectively to form first and second interdigital sets, a conductive wall extending in the direction of said stream and disposed from said interaction faces opposite said stream, a portion of the length of each finger extending as a vane to join said wall, said portion extending to one end of said finger and substantially short of the other end, said one end being a corresponding end of each finger in said first set and the opposite end of each finger in said second set.

6. The apparatus of claim 5 wherein said fingers are substantially perpendicular to said direction of mean flow.

7. The apparatus of claim 5 wherein said one end is the end of said finger not joined to said strap.

8. The apparatus of claim 5 wherein said one end is the end of said finger joined to said strap.

9. The apparatus of claim 5 wherein said straps extend to join said wall.

* * * * *